United States Patent [19]

Tank

[11] Patent Number: 4,791,949

[45] Date of Patent: Dec. 20, 1988

[54] METHOD OF DISCHARGING SEWAGE BY VACUUM AND CONTROL APPARATUS FOR CARRYING THE METHOD INTO EFFECT

[75] Inventor: Wolfgang Tank, Uetersen, Fed. Rep. of Germany

[73] Assignee: Oy Wartsila Ab, Helsinki, Finland

[21] Appl. No.: 88,661

[22] Filed: Aug. 24, 1987

[30] Foreign Application Priority Data

Aug. 29, 1986 [DE] Fed. Rep. of Germany ..... 3629484

[51] Int. Cl.[4] ..... E03F 1/00

[52] U.S. Cl. ..... 137/1; 137/205; 137/236.1; 4/431

[58] Field of Search ..... 137/205, 236.1, 1; 4/431

[56] References Cited

U.S. PATENT DOCUMENTS 4,108,192 8/1978 Michael ..... 137/1

4,155,851 5/1979 Michael ..... 137/236.1

FOREIGN PATENT DOCUMENTS 1073317 8/1980 Canada .

*Primary Examiner*—Alan Cohan

*Attorney, Agent, or Firm*—Dellett, Smith-Hill and Bedell

[57] ABSTRACT

It is essential for optimum operation of a vacuum sewage line to cause an injection of air to follow behind a preceding operation of removal of sewage by suction. The invention solves the problem of dividing large quantities of sewage that are produced into portions and of conveying them through the vacuum sewage pipe by the triggering of a secondary air valve for the supply of air necessary after each suction operation.

15 Claims, 2 Drawing Sheets

METHOD OF DISCHARGING SEWAGE BY VACUUM AND CONTROL APPARATUS FOR CARRYING THE METHOD INTO EFFECT

BACKGROUND OF THE INVENTION

The invention relates to a method of discharging sewage and to a control apparatus for carrying the method into effect.

A method for discharging sewage by vacuum is described, for example, in German Patent Specification No. 24 55 551. In the prior method, sewage is first collected at a connection point and then drawn off in a specific quantity by vacuum, air being sucked into the vacuum sewage pipe behind the sewage. Each suction operation is initiated by means of a suction valve unit on accumulation of about 10–15 liters of sewage. After the sewage has been sucked off out of the preliminary storage tank, the sewage suction valve is kept open a little longer through a time delay. In this manner, the air necessary for conveyance of the sewage is drawn into the sewage pipe through the sewage suction valve, which has been left open, after the sewage. That is to say, the necessary air is sucked in afterwards immediately between the comparatively small portions of sewage.

A control apparatus for carrying the described method into effect is known from German Patent Specification No. 24 62 295.

In clubhouses of sports grounds, camp sites, public facilities such as toilet installations, inns, etc., so much sewage is produced within a short time as a result of the simultaneous use of several toilets, showers and washbasins that the relatively small preliminary storage tank or basin is constantly full and, consequently, at each suction operation, only sewage is passed into the sewage pipe by way of the sewage suction valve. Consequently, the vacuum sewage pipe is constantly further filled, but the sewage in the pipe is not transported because no air for conveyance or only very little air can be drawn in as well. The entire run or line ceases to function and can only be made to work again if air is fed forcibly into the pipe at a plurality of points. This method, however, is very time-consuming and associated with a disturbance of operation.

The problem underlying the invention is to provide a method of discharging sewage by vacuum and the associated control apparatus which work reliably even where there is considerable production of sewage.

SUMMARY OF THE INVENTION

This problem is solved with a method and a control apparatus as characterised in the accompanying claims.

The invention solves the problem of dividing large amounts of sewage that are produced into portions and of conveying them through the vacuum sewage pipe by the triggering of a secondary air valve for the supply of air necessary after each suction operation.

It is essential for the optimum operation of a run or line to cause the supply of air to take place in principle after a preceding suction operation. The admixture of air during a suction operation does not give the desired result, because sewage and air must first separate in the pipe so that a plug of sewage will form. If, however, the sewage is introduced into the pipe first and air afterwards, then the necessary plug is already present in the pipe and the air flowing after the plug pushes it in front of it. This principle can be achieved by opening the secondary air valve only after the sewage suction valve has reclosed.

The amounts of sewage produced in specified intervals accumulate in large laying-up basins which are already known. The removal of sewage in portions by suction and the following drawing-in of secondary air may take place until a bottom sewage level is reached in the laying-up basin, i.e. the necessary supply of air always takes place via the secondary air inlet. This has the advantage that siphons cannot be sucked empty and if the control apparatus is arranged in the house no annoying development of noise occurs.

The removal of sewage in portions by suction and the following drawing-in of secondary air may also take place until the basin is completely emptied and sufficient primary air has been sucked in behind the last portion of sewage. Such a procedure will be preferred where in general only a small accumulation of sewage occurs and the initiation of a suction operation or a suction sequence takes place through an enclosed air cushion, as described in the said German Patent Specification No. 24 62 295. If difficult piping conditions are present, it is necessary to feed only as much air into the systems as is needed for transport. Too much or too little air would cause the run to be overwhelmed. The effect of the method is that the secondary air valve provided for the supply of air is opened only when insufficient air or no air necessary for conveying the sewage is drawn in via the sewage suction valve.

Every vacuum sewer system consists as a rule of a plurality of pipes which may be different in length and diameter, slope and the number of connected sewage accumulation points, so that it is necessary to adapt the air supply to the needs of the system. This is done by making the opening time of the secondary air valve adjustable.

It may happen that a leak occurs in the mains system or that there is a fault at the station which produces the vacuum, so that the vacuum in the piping is reduced to such an extent that, in spite of supply of air, no conveyance of the sewage is possible. If such a condition were to occur, this run or line would be completely overwhelmed by the supply of sewage and air. The input of sewage and/or air is therefore made possible only when an adequate working vacuum is available. The system operates only when the vacuum at the control apparatus is so high that it can actuate a valve which is adjustable to the vacuum necessary for conveyance.

As described hereinbefore in connection with one procedure, the opening and closing of the sewage suction valve and of the secondary air valve is initiated through the medium of a constantly reforming air cushion. The air cushion can form in that the air cannot escape upwardly in a vertical rising pipe and, consequently, exerts a pressure on a diaphragm through which a valve is operated and control is initiated. The sewage building up from below and the control box which is mounted with a roller cage on the rising pipe form the lower limit and upper limit, respectively, for the air cushion. If the connection, which can be removed at any time, became leaky, however, the air cushion could escape or not re-form. Control would consequently not be initiated and the sewage suction valve would not open, and consequently the backwash chambers would fill with sewage. The level of the control box is substantially lower than that of the backwash chambers. If the control box were removed from the rising pipe, an equalization of level would take place immediately and the sewage would penetrate via the now open rising pipe with the installed valves and render them unusable.

The invention relates to the possibility of regenerating this air cushion necessary for initiating control manually, for example with an air pump, in the event of operating troubles of the kind described and, consequently, of preventing flooding of the valve space.

BRIEF DESCRIPTION OF THE DRAWINGS

The invention is described in detail hereinafter with reference to the accompanying drawings, in which.

DETAILED DESCRIPTION

Figure 1:
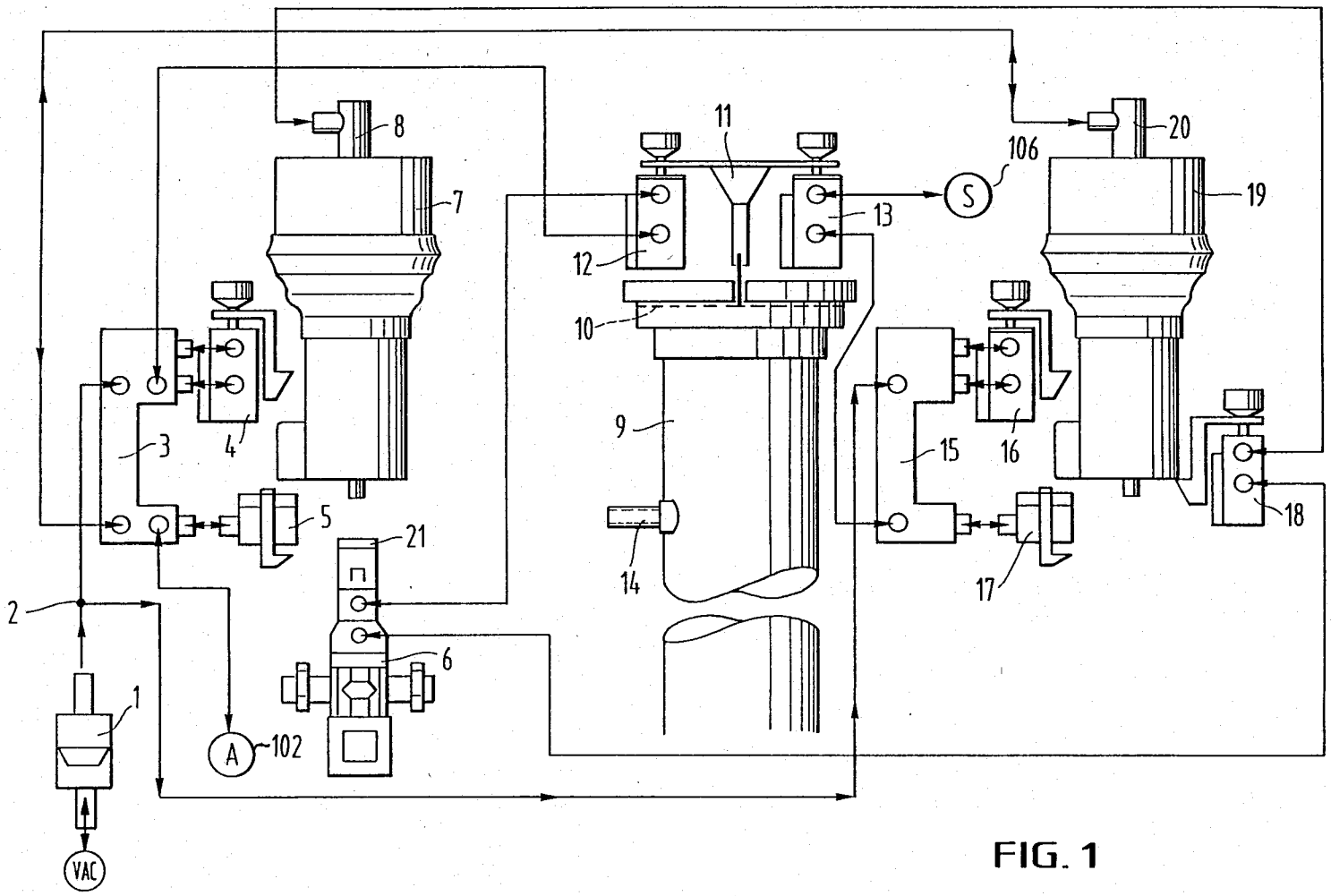
FIG. 1 is a diagram of control apparatus for carrying the method according to the invention into effect.

Sewage from sewage producing units accumulates in a tank 100 (FIG. 2) which is connected by way of a sewage suction valve 102 to a sewage pipe 104. Downstream of the sewage suction valve 102, a secondary air valve 106 is connected between the atmosphere and the interior of the pipe 104. An activator pipe 9, shown also in FIG. 1, is mounted in the tank 100.

Figure 2:
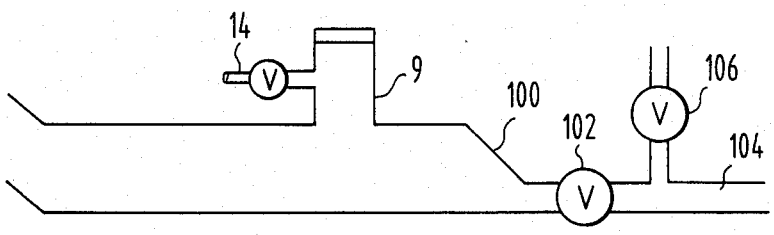
FIG. 2 is a simplified diagram of a portion of a vacuum sewage system including the FIG. 1 control apparatus.

The control apparatus for the valves 102 ad 106 is shown in FIG. 1.

Initial position:

By way of a blockage suppressor, namely a check valve 1 and a T-piece 2, negative pressure check valve 1 and a T-piece 2, partial vacuum (VAC) is present at the distributor valves 3 and 15. Timers 7 and 19, which are, for example, operating servos having a piston loaded by a return spring as described in German Patent Specification No. 24 62 295, are in the lower or rest position. The timer 7 holds a starter valve 6 open via an operating arm 21 and, at the same time keeps a ventilating valve 5 open through a laterally located projection. The timer 19 holds a ventilating valve 17 open with its lateral projection and keeps a vacuum valve 18 in the open position.

Initiation:

If, as a result of inflow of sewage into the accumulation tank 100, air is trapped in the activator pipe 9, which is in communication with the storage chamber and is closed at the top by the diaphragm 10. The trapped air creates a cushion, and the diaphragm 10 is deflected upwards and its initiating or triggering pin, through an actuating lever 11, operates vacuum valves 12 and 13 to the open position. Now, via the distributor valve 3, the vacuum valve 12, the starter valve 6 and the vacuum valve 18, a partial vacuum is applied to the nozzle holder and nozzle 8 of the timer 7 and brings the timer 7 into the upper position. At the same time, the ventilating valve 5 closes.

If the vacuum in the sewage pipe is sufficient for transportation of sewage, the starter valve 6 interrupts the vacuum supply from the valve 12 and ventilates the nozzle holder and nozzle 8 via the valve 18. The timer 7 therefore remains in the upper position of readiness until a predetermined level of partial vacuum operates or changes over the starter valve 6. Only then can the control process proper commence. By ventilation of the nozzle 8 via the valve 18, the timer 7 moves downwardly more or less quickly according to the size of the nozzle 8. During this downward movement, the projection located laterally on the timer 7 travels past the vacuum valve 4. This opens and supplies partial vacuum via the distributor valve 3 to the sewage suction valve 102 in order to open it. At the same time, negative is communicated via the distributor valve 3 to the nozzle holder and nozzle 20 on the timer 19. As a result, the timer 19 is brought into the upper position (position of readiness) and the ventilating valve 17 and the vacuum valve 18 are closed.

The lateral projection on the timer 7 now releases the vacuum valve 4, so that this closes. The timer 7 now again reaches its lower position (rest position) and it opens the ventilating valve 5. The sewage suction valve 102 is ventilated via the valve 5 and closes.

The suction operation is terminated.

Alternative 1:

If the accumulation tank 100 has been completely emptied towards the end of the suction operation, the air that was trapped in the activator pipe 9 escapes and a pressure equalization takes place. The diaphragm 10 with its triggering pin and, consequently, the actuating lever 11 are lowered and the vacuum valves 12 and 13 close. The timer 7, having arrived in the lower position, now actuates the starter valve 6 again through the operating arm 21. Simultaneously with the actuation of the ventilating valve 5, the timer 19 is also ventilated via nozzle 20 and valve 3 and it commences its downward movement. Its speed is defined by nozzle 20. Partial vacuum present by way of T-piece 2 at the distributor valve 15 and the vacuum valve 16 cannot become effective at the secondary air valve 106 in spite of opening of the valve 16, since the vacuum valve 13 is closed through lack of superatmospheric pressure in the activator pipe 9. The timer 19 also now reaches its lower position. As a result, the valve 16 closes, while the valves 17 and 18 are opened. The entire control process is concluded. On supply of additional sewage, an air cushion (superatmospheric pressure) is produced in the activator pipe 9 and the valve 12 is thereby opened and the suction operation is repeated.

Alternative 2:

Course of control when there is a considerable production of sewage and overfilling of the suction storage chamber has taken place as a result. This overfilling may also be caused by temporary disturbance of the vacuum supply.

By reason of the overfilling of the suction storage chamber; it has not been possible to draw in any following air in the preceding suction operation, and the air cushion enclosed by the sewage is maintained in the activator pipe 9. The vacuum valves 12 and 13 remain open through action of the diaphragm and lever 11. The timer 19 is ventilated through the ventilating valve 5 and begins its downward movement. The vacuum valve 16 is opened by the lateral projection on the timer 19. Partial vacuum is now applied from the T-piece 2 by way of the distributor valve 15 and the vacuum valves 16 and 13 to the secondary air valve 106 and opens it. The injection of secondary air begins and in fact at a point in the direction of flow immediately behind the now closed sewage suction valve 102. The opening time of the valves 16 and 106 can be defined by the nozzle 20. When this time has expired, the timer 19 has reached the lower position and the vacuum valve 16 is closed. The ventilating valve 17 is open, as a result of which the secondary air valve 106 closes. The injection of the amount of secondary air needed for the previously sucked off sewage is at an end. At the same time, the timer 19 which has now come to rest in the lower position opens the vacuum valve 18. The sequence of opening and closing the sewage suction valve 102 and then opening and closing the secondary air valve 106 will now repeat itself, until the overfilling has been removed and air can already be drawn in while the valve 102 is open. The air cushion in the activator pipe 9 is then released and the vacuum valves 12 and 13 close. The termination of the control sequence takes place as described under Alternative 1.

The activator pipe 9 is provided with an air inlet valve 14 for manual regeneration of the air cushion.

It will be appreciated that the present invention is not restricted to the particular embodiment that has been described and illustrated, and that variations may be made therein without departing from the scope of the invention as defined in the appended claims and equivalents thereof.

I claim:

1. A method of operating a vacuum sewer system that comprises a sewage valve, a sewage collecting tank upstream of the sewage valve, and a sewage pipe downstream of the sewage valve and under partial vacuum, said method comprising:

(a) opening the sewage valve and admitting a predetermined quantity of sewage into the sewage pipe from the sewage collection tank, (b) closing the sewage valve, and, if insufficient air for transportation of sewage was admitted into the sewage pipe by way of the sewage valve while the sewage valve was open, (c) opening a secondary air valve and admitting air into the sewage pipe upstream of the sewage admitted in step (a) and then closing the secondary air valve.

2. A method according to claim 1, further comprising repeating steps (a) and (b) until a bottom sewage level is reached.

3. A method according to claim 1, further comprising repeating steps (a) and (b) until sufficient air for transportation of sewage is admitted into the sewage pipe by way of the sewage valve.

4. A method according to claim 1, comprising, before step (a), determining whether the level of vacuum in the vacuum sewage pipe is sufficient for transportation of sewage, and carrying out steps (a) and (b) only if the level of vacuum is sufficient for transportation of sewage.

5. A vacuum sewage system comprising a sewage collecting tank defining an interior space for receiving sewage and having an outlet, a sewer pipe defining an interior space which can be placed at a pressure that is lower than that in the interior space of the tank, a sewage valve connected between the sewer pipe and the outlet of the tank for controlling passage of material between the tank and the sewer pipe, a secondary air valve which communicates with the sewer pipe, and means for controlling operation of the sewage valve and the secondary air valve such that the sewage valve opens automatically when the sewage in the tank reaches a predetermined level and admits a predetermined quantity of sewage into the sewer pipe, and the sewage valve then closes, and if insufficient air for transportation of sewage was admitted into the sewer pipe by way of the discharge valve while the sewage valve was open, the secondary air valve is opened to admit air into the sewer pipe and is then closed.

6. A system according to claim 5, comprising timing means for controlling the interval for which the sewage valve is opened and the interval for which the secondary air valve is opened.

7. A system according to claim 6, wherein the times for which the sewage valve and the secondary air valve are opened are variable independently of each other.

8. A system according to claim 5, comprising an activator which, when the sewage in the tank reaches said predetermined level and until sufficient sewage has been removed that the sewage has fallen to the level of the outlet opening, actuates an operating element in an operating circuit for the sewage valve and an operating element in an operating circuit for the secondary air valve.

9. Apparatus according to claim 8, wherein the sewage valve and the secondary air valve are vacuum-operated valves and said operating elements are vacuum valves.

10. Apparatus according to claim 8, comprising a starter valve which allows removal of the sewage from the tank to be initiated only when the level of vacuum in the sewer pipe is sufficient for transportation of sewage.

11. Apparatus according to claim 8, wherein the activator comprises means defining a chamber for accommodating an air cushion over the sewage in . the tank, and said operating elements are responsive to the pressure of the air cushion reaching a predetermined value.

12. Apparatus according to claim 11, wherein the activator is provided with an air inlet valve for manual regeneration of the air cushion.

13. A system according to claim 5, comprising means for holding the sewage valve open for a predetermined time and then closing the sewage valve.

14. A method according to claim 1, comprising opening the sewage valve when the sewage in the tank reaches a predetermined level, holding the sewage valve open for a predetermined time, and then closing the sewage valve.

15. A method according to claim 1, wherein the sewage valve is a vacuum operated valve and the method comprises communicating vacuum to the sewage valve when the sewage in the tank reaches a predetermined level and ventilating the sewage valve after a predetermined time.

* * * * *